US009788628B1

(12) United States Patent
Goodwin et al.

(10) Patent No.: US 9,788,628 B1
(45) Date of Patent: Oct. 17, 2017

(54) DOUBLE FACE HAIR BARRETTE

(71) Applicant: GABBY, LLC, Columbia, SC (US)

(72) Inventors: Rozalynn B Goodwin, Columbia, SC (US); Robert Gibson, Charlotte, NC (US); Matt Green, Charlotte, NC (US)

(73) Assignee: Gabby, LLC, Columbia, SC (US)

( * ) Notice: Subject to any disclaimer, the term of this patent is extended or adjusted under 35 U.S.C. 154(b) by 59 days.

(21) Appl. No.: 14/539,563

(22) Filed: Nov. 12, 2014

Related U.S. Application Data

(60) Provisional application No. 61/902,557, filed on Nov. 11, 2013.

(51) Int. Cl.
*A45D 8/30* (2006.01)
*A45D 8/26* (2006.01)
*A45D 8/00* (2006.01)

(52) U.S. Cl.
CPC ..... *A45D 8/26* (2013.01); *A45D 8/30* (2013.01); *A45D 2008/004* (2013.01)

(58) Field of Classification Search
CPC ... A45D 8/00; A45D 8/12; A45D 8/14; A45D 8/16; A45D 8/20; A45D 8/22; A45D 8/24; A45D 8/26; A45D 8/28; A45D 8/30; A45D 8/32; A45D 8/34; A45D 8/36; A45D 2008/004; A45D 2008/002; A45D 2008/345; A45D 24/06; A45D 24/10; Y10T 24/44291; Y10T 24/44325; Y10T 24/3431; Y10T 24/3439; Y10T 24/44274; A44C 5/24
USPC ..... 132/275, 124–137, 144–146, 273, 132/276–279, 141, 142; D28/21–34, D28/39–43
See application file for complete search history.

(56) References Cited

U.S. PATENT DOCUMENTS

| | | | | | |
|---|---|---|---|---|---|
| 1,437,334 | A | * | 11/1922 | Battersby | 132/260 |
| 1,447,998 | A | * | 3/1923 | Popin | 132/256 |
| 1,496,329 | A | * | 6/1924 | Stumph | 132/260 |
| 3,998,233 | A | * | 12/1976 | Dorr | 132/279 |
| D260,453 | S | * | 9/1981 | Carlson | D11/213 |
| D276,274 | S | | 11/1984 | Bezanson et al. | D28/42 |
| D318,540 | S | | 7/1991 | Carter | D28/42 |
| D342,769 | S | | 12/1993 | Stangl | D21/585 |
| 5,546,966 | A | * | 8/1996 | Lin | 132/279 |
| 5,597,000 | A | * | 1/1997 | Gerber | 132/279 |
| 5,605,166 | A | * | 2/1997 | Chou | 132/279 |
| 5,638,836 | A | * | 6/1997 | Yasuda | 132/279 |
| 5,816,267 | A | * | 10/1998 | Chou | 132/145 |

(Continued)

*Primary Examiner* — Todd E Manahan
*Assistant Examiner* — Brianne Kalach
(74) *Attorney, Agent, or Firm* — Amy Allen Hinson; Nexsen Pruet, LLC

(57) ABSTRACT

A hair barrette for securing hair is disclosed. The hair barrette includes a first, second, and third segment. The first and second segments each have a first side having teeth and a catch, and an opposing second side having an ornamental design. The third segment is positioned between the first and second segments and may have a first end, a second end, a first opening adjacent to the first end, and a second opening adjacent to the second end. The catch of the first segment is insertable into the second opening of the third segment and the catch of the second, segment is insertable into the first opening of the third segment. Further the ornamental designs are visible when said the catches are inserted into the openings.

20 Claims, 7 Drawing Sheets

(56) References Cited

U.S. PATENT DOCUMENTS

| | | | | | |
|---|---|---|---|---|---|
| 5,857,469 | A | | 1/1999 | Sowell | |
| 5,862,814 | A | * | 1/1999 | Janik et al. | 132/275 |
| 5,881,741 | A | * | 3/1999 | Chen | 132/277 |
| 5,893,377 | A | * | 4/1999 | Chen | 132/275 |
| 6,024,102 | A | | 2/2000 | Huang | |
| 6,047,705 | A | * | 4/2000 | Hawley | 132/128 |
| 6,089,240 | A | * | 7/2000 | Chang | 132/273 |
| 6,237,610 | B1 | * | 5/2001 | Trevisan | 132/273 |
| 6,257,249 | B1 | * | 7/2001 | Thomas et al. | 132/273 |
| 6,634,366 | B1 | * | 10/2003 | Simmons | A41G 5/0073 132/278 |
| 6,681,779 | B2 | * | 1/2004 | Stachowski | 132/279 |
| D492,197 | S | | 6/2004 | Pearson et al. | D9/451 |
| D493,013 | S | * | 7/2004 | Stachowski | D28/42 |
| D493,572 | S | * | 7/2004 | Stachowski | D28/42 |
| D494,340 | S | | 8/2004 | Baumhogger et al. | D99/34 |
| 6,981,507 | B2 | | 1/2006 | Gabriele-Baumann | |
| D540,602 | S | | 4/2007 | Tascoe | D6/580 |
| D583,995 | S | * | 12/2008 | Pichon | D28/40 |
| 8,789,537 | B2 | * | 7/2014 | Loredo | 132/200 |
| 2006/0096609 | A1 | * | 5/2006 | Nwokola | 132/201 |
| 2007/0023061 | A1 | * | 2/2007 | Dorazio | 132/55 |
| 2007/0283976 | A1 | * | 12/2007 | Adams | 132/133 |
| 2010/0242987 | A1 | * | 9/2010 | Washington | 132/275 |
| 2012/0048293 | A1 | * | 3/2012 | Hsu | 132/279 |
| 2013/0186424 | A1 | * | 7/2013 | Zachery | 132/275 |

* cited by examiner

DOUBLE FACE HAIR BARRETTE

CROSS-REFERENCE TO RELATED APPLICATIONS

This application is related to and claims priority to U.S. Provisional Patent Application No. 61/902,557 filed Nov. 11, 2013, which is incorporated herein by reference.

BACKGROUND

The present invention discloses a hair barrette and more particularly a hair barrette with multiple faces that is highly suitable for holding thick, curly, or kinky hair.

Existing hair barrettes typically include a one sided face with a snap fastener across the back of the face to secure hair. Such barrettes frequently slip and fail to properly hold hair for extended periods of time. Further, such barrettes are inadequate for use with thick, curly, or kinky hair because the barrettes often rotate so that the fastener instead of the design is viewable.

Thus, there is a need in the art for a barrette that is particularly suitable for holding thick, curly, or kinky hair.

SUMMARY

The present invention includes a hair barrette for securing hair. In one embodiment of the hair barrette, the barrette includes a first, second, and third segment. The first segment has a first side and an opposing second side. The first side includes first teeth and a first catch. Further, the opposing second side includes a first ornamental design. The second segment has a third side and an opposing fourth side. The third side includes second teeth and a second catch. Further, the fourth side includes a second ornamental design. The third segment is positioned between the first and second segments and has a first end, a second end, a first opening adjacent to the first end, and a second opening adjacent to the second end. The third segment further includes a first hinge at the first end and a second hinge at the second end. The first hinge is positioned adjacent to the first segment and the second hinge is positioned adjacent to the second segment. The first catch of the first segment is insertable into the second opening, of the third segment and the second catch of the second segment is insertable into the first opening of the third segment. The first ornamental design is visible when the first catch is inserted into the second opening and the second ornamental design is visible when the second catch is inserted into the first opening.

In an alternative embodiment of the hair barrette, the barrette includes a first, second, and third segment. The first segment has a first side and an opposing second side wherein the first side has first teeth and a first catch and the opposing second side includes a first ornamental design. The second segment has a third side and an opposing fourth side wherein the third side has second teeth and a second catch and the fourth side includes a second ornamental design. The third segment is positioned between the first and second segments and has a first opening and a first hinge. The first catch of the first segment is for insertion in the first opening of the third segment.

DETAILED DESCRIPTION OF REPRESENTATIVE EMBODIMENTS

The present invention is related to a hair barrette that is particularly suitable for use for holding thick, curly or kinky hair. The unique design and features of the hair barrette preferably allow the barrette to rotate while always disclosing the ornamental design instead of the fastener. Although primarily described herein in terms of its use with thick, curly, or kinky hair, it will be clear that the hair barrette may be used in connection with all types of hair. The invention will be described with reference to the figures, which are an integral non-limiting component of the invention. Throughout the description similar elements will be numbered accordingly.

Figure 1:
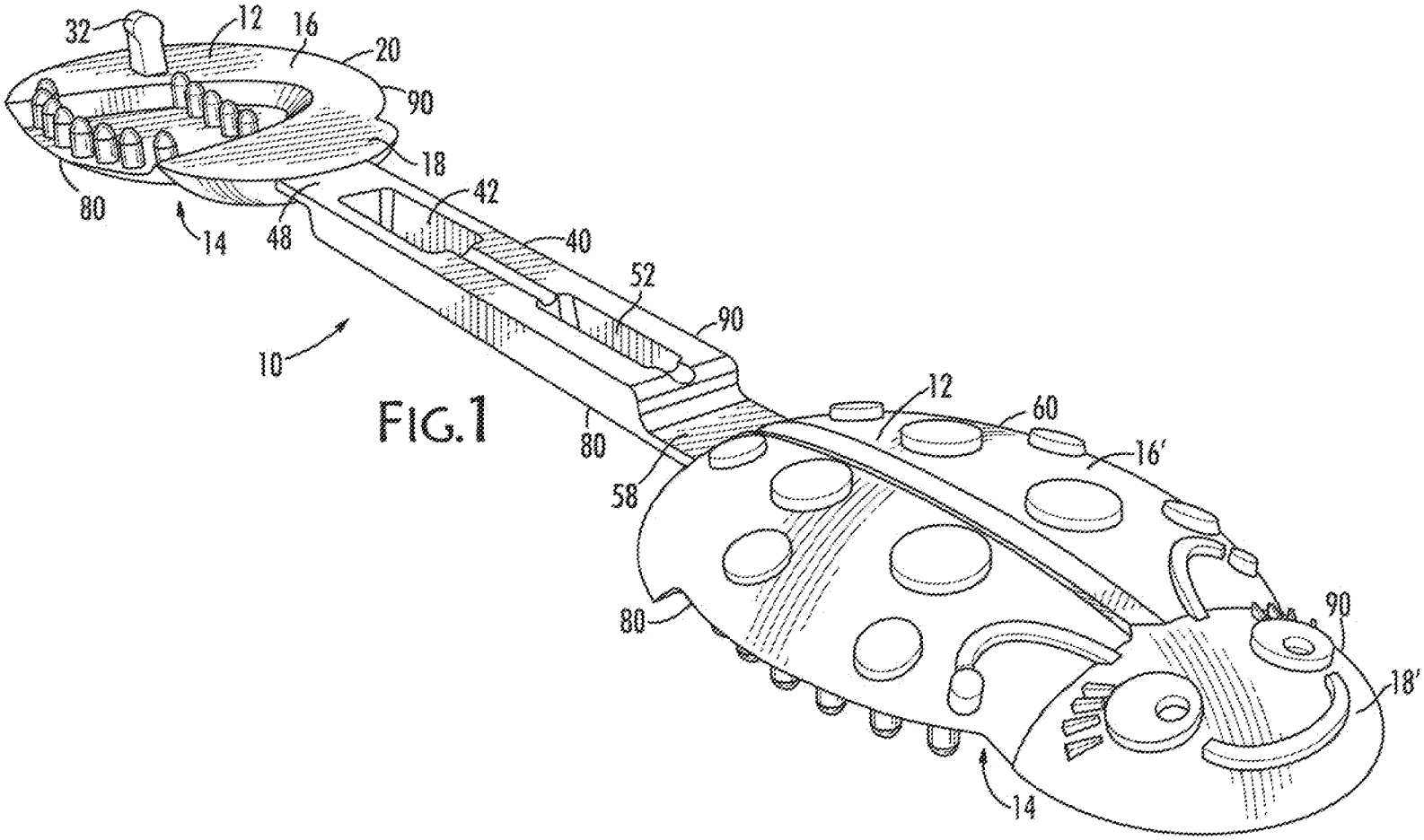
FIG. 1 is a perspective view of an embodiment of the double faced hair barrette of the present invention.

FIG. 1 discloses an embodiment of the double face hair barrette 10 of the present invention. In this embodiment, the barrette includes first, second, and third segments, 20, 40 and 60, respectively, to create a three-part barrette that securely holds thick, curly or kinky hair. As shown in FIG. 1, the second segment 40 forms a substantially rectangular strip that is positioned between the first segment 20 and third segment 60. The first and third segments 20 and 60, respectively, incorporate ornamental designs, such as a lady bug design. Typically, for cost savings as well as to retain a lightweight barrette, the barrette of the present invention is composed of plastic. Alternative materials, such as metals or composite materials however may be used without departing from the spirit and scope of the present invention.

Figures 2, 3:
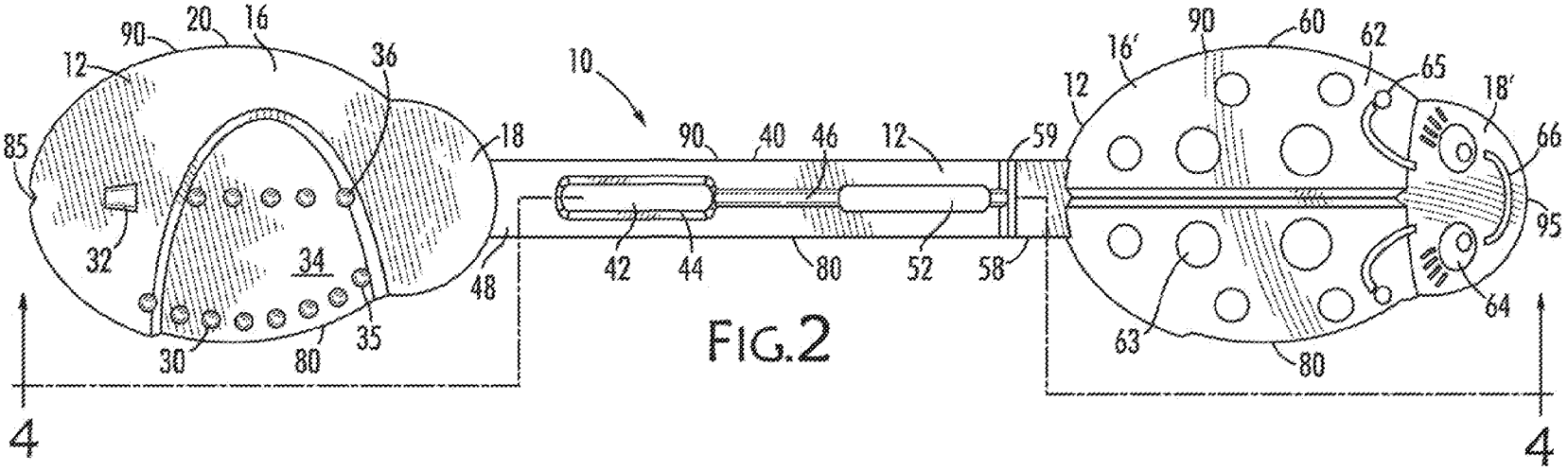
FIG. 2 is a top plan view of the embodiment of FIG. 1.
FIG. 3 is a bottom plan view of the embodiment of FIG. 1.

FIGS. 2 and 3 disclose a first side view and a second side view of the barrette 10 of FIG. 1. More specifically, FIG. 2 discloses a first side 12 of the barrette 10 while FIG. 3 discloses the opposing second side 14 of the barrette 10. As shown in FIG. 2, the first side 12 of third segment 60 includes an ornamental design 62 of a lady bug. For example, the design 62 includes spots 63, eyes 64, antenna 65, and a mouth 66. Likewise, as shown in FIG. 3, the second side 14 of first segment 20 includes a similar ornamental design 22 of a lady bug. For example, the design 22 includes spots 23, eyes 24, antenna 25, and a mouth 26.

In contrast, as shown in FIG. 2, the first side 12 of first segment 20 includes first teeth 30, a first catch 32, and a first depression 34. As further discussed below, the first catch 32 is for securing the dip in a closed position on the first side 12 when hair is inserted and the first teeth 30 and first depression 34 are for securing hair within the barrette on the first side 12. As shown in FIG. 3, the second side 14 of third segment 60 likewise includes second teeth 70, a second catch 72, and a second depression 74. The second catch 72 is for securing the clip in a closed position on the second side 14 when hair is inserted and the second teeth 70 and second depression 74 are for securing hair within the barrette on the second side 14.

Figure 4A:
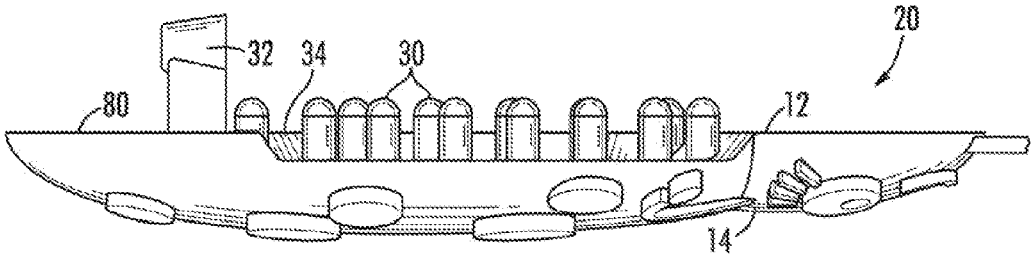
FIG. 4A is a first segment of a first side elevation view taken at line 4-4 of FIG. 2.
Figure 4B:
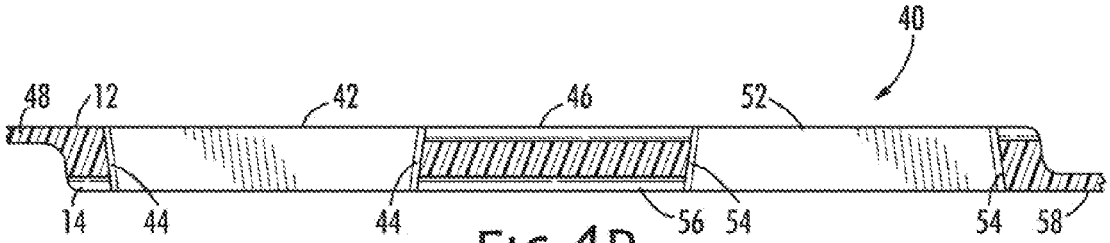
FIG. 4B is a second segment of a first side elevation view taken at line 4-4 of FIG. 2.
Figure 4C:
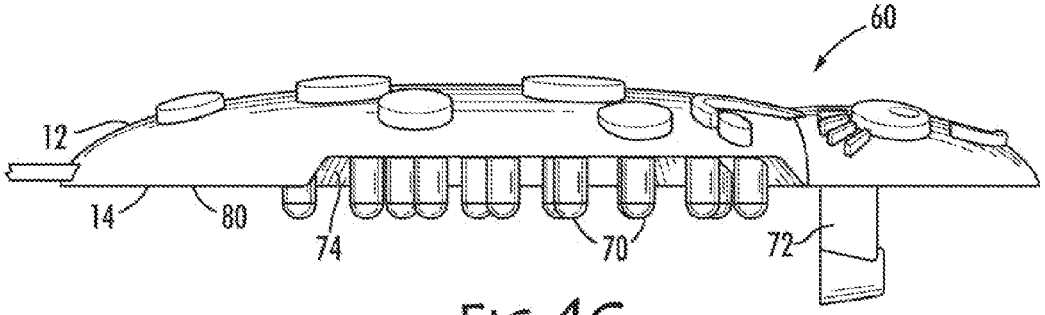
FIG. 4C is a third segment of a first side elevation view taken at line 4-4 of FIG. 2.

FIGS. 4A, 4B, and 4C disclose elevation views taken at line 4-4 of FIG. 2. FIGS. 4A and 4C clearly show depressions 34 and 74, which allow space for capturing hair between teeth 30 and 70 of barrette 10. In the embodiment shown in FIG. 1, catch 32 includes a stem with a rounded top which is particularly preferred for providing less damage to the hair and for ease in opening and closing barrette 10. Catch 72 may have a similar or distinct configuration as catch 32. Furthermore, alternative configurations, such as an arrow shape top, are considered, without departing from the spirit and scope of the present invention.

In the embodiment of FIGS. 2 and 3, the barrette 10 includes a first outer edge 80 and a second outer edge 90. A first row of teeth 35 are positioned along the first outer edge 80 at first segment 20 of barrette 10 and a second row of teeth 36 are positioned along the centerline of barrette 10. Likewise, a first row of teeth 75 are positioned along the first outer edge 80 at third segment 60 of barrette 10 and a second row of teeth 76 are positioned along the centerline of barrette 10. Alternatively, the first rows of teeth 35 and 75 may be positioned along second outer edge 90. In yet a further alternative embodiment, the first row of teeth 35 may be positioned along first outer edge 80 and the first row of teeth 75 may be positioned along second outer edge 90.

As discussed above and shown in FIGS. 2 and 3, the second segment 40 of barrette 10 is generally rectangular shaped and extends between the first and third segments 20 and 60, respectively. The second segment 40 includes a first opening 42 and a second opening 52. In the embodiment of FIGS. 2 and 3, and as shown in more detail in FIG. 4B, the openings 42 and 52 extend entirely through the first side 12 and second side 14 of barrette 10. Alternatively, the opening 42 does not extend entirely through second side 14 and/or the opening 52 does not extend entirely through first side 12. As further discussed below, when the barrette 10 is closed, first catch 32 is inserted into opening 52 and second catch 72 is inserted into opening 42. In the embodiment of FIG. 1, openings 42 and 52 are rectangular in shape, which is larger than the latch in length. Such a dimension allows for variation in the amount of hair inserted in the barrette 10 and positions of the catches 32 and 72. For example, the catches 32 and 72 may be positioned closer to the center of the barrette 10 when more hair is enclosed. Likewise, when less hair is inserted, the catches 32 and 72 may be positioned further from the center of the barrette 10. In an alternative embodiment, the openings are oval in shape or exactly match the dimensions of the catches 32 and 72.

In the embodiment of FIGS. 2 and 3 and as clearly shown in FIG. 4B, the opening 42 and 52 may be tapered. For example, because catch 32 of first segment 20 is inserted into opening 52, opening 52 is tapered so that it has a smaller opening on first side 12 than on second side 14. Likewise, because catch 72 of third segment 60 is inserted into opening 42, opening 42 is tapered so that it has a smaller opening on second side 14 than on first side 12. A tapered edge 44 of opening 42 is shown in FIG. 2 and a tapered edge 54 of opening 52 is shown in FIG. 3. The configuration of the openings and tapering as shown in FIG. 4B allows for effective securing of catches 32 and 72 and allows for easy removal of the catches from the openings 42 and 52 when hair is to be removed. Alternative configurations are however contemplated and may vary depending upon the design and configurations of catches 32 and 72. For example, in an alternative embodiment, the openings do not taper. In yet another embodiment, the catch extends entirely through the openings and locks on the opposing side of the second segment 40.

As also shown in FIGS. 2 and 3, the second segment 40 may also include slot 46 on first side 12 and slot 56 on second side 14. In the embodiment of FIGS. 2 and 3, the slot 46 provides a recess for second row of teeth 36 when the barrette 10 is in the closed position. Similarly, the slot 56 provides a recess for the second row of teeth 76 when the barrette 10 is in the closed position. As shown in FIGS. 1 and 4B, slot 46 is disposed on the first side 12 and extends only partially into second segment 40 such that it does not extend through to the second side 14. Similarly, as shown in FIG. 4B, slot 56 is disposed on the second side 14 and extends only partially into second segment 40 such that it does not extend through to the first side 12.

Figure 5:
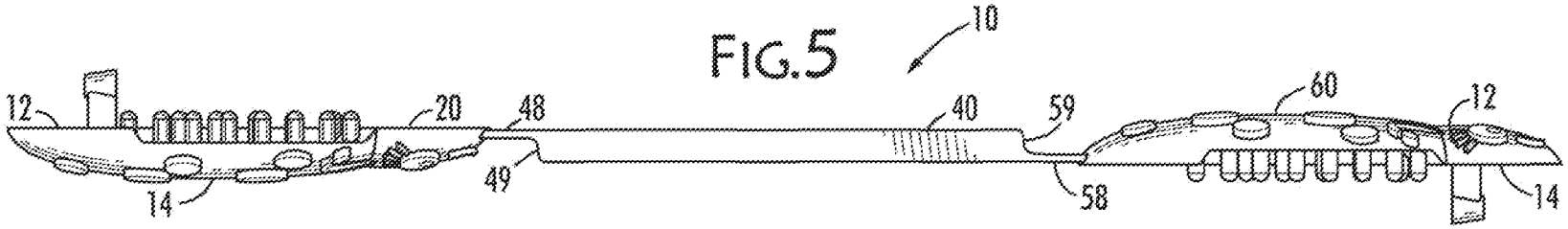
FIG. 5 is a first side elevation view of an embodiment of the double faced hair barrette of the present invention.
Figure 6:
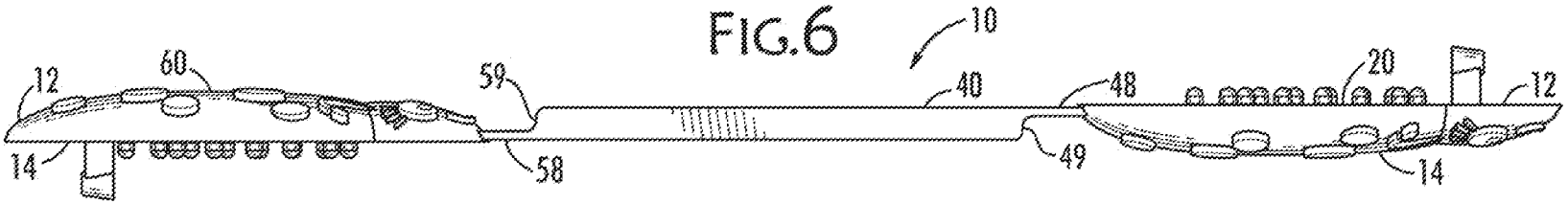
FIG. 6 is an opposing second side elevation view of the embodiment of FIG. 5.

As more clearly shown in FIGS. 5 and 6, the second segment 40 of barrette 10 also includes a first hinge 48 connecting first segment 20 and second segment 40. While alternative hinges may be considered, the hinge 48 of this embodiment is a reduced material hinge. Because hinge 48 is a reduced material hinge, a slope 49 is created from the second side 14 of second segment 40 to the hinge 48. Similarly, as also shown in FIGS. 5 and 6, the second segment 40 of barrette 10 also includes a second hinge 58 connecting third segment 60 and second segment 40. Because hinge 58 is a reduced material hinge like hinge 48, a slope 59 is created from the first side 12 of second segment 40 to the hinge 58. As shown in FIGS. 5 and 6, hinges 48 and 58 extend laterally outward from opposing ends of the second segment 40. Moreover, as shown in FIGS. 1, 2, 3, and 4B, hinge 48, opening 42, and opening 52 are linearly aligned. Likewise, hinge 58, opening 42, and opening 52 are also linearly aligned.

Figure 7:
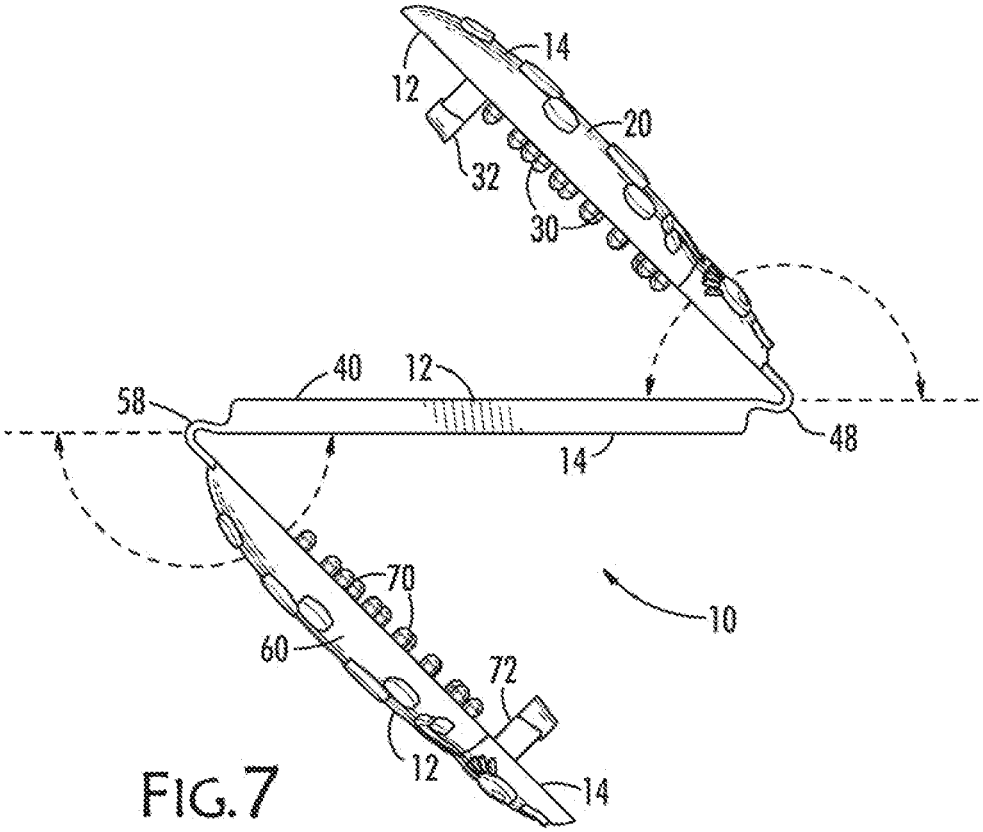
FIG. 7 is an elevation view of an embodiment of the double faced hair barrette of the present invention showing how the barrette transitions from an extended position to a closed position.
Figure 8:
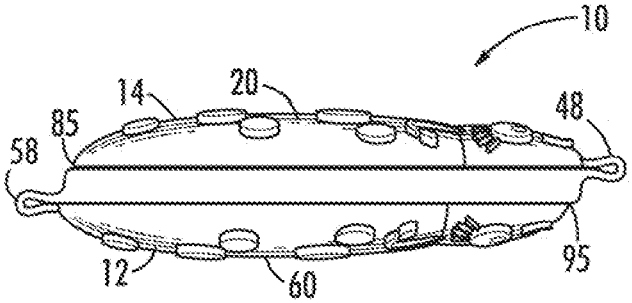
FIG. 8 is an elevation view of an embodiment of the double faced hair barrette of the present invention in the closed position.

As shown in FIG. 7, the hinge 48 bends upward to allow the first segment 20 to collapse over the first side 12 of second segment 40. As also shown in FIG. 7, the hinge 58 bends downward in the opposite direction as hinge 48 to allow the third segment 60 to collapse under the second side 14 of second segment 40. When both the first and third segments 20 and 60, respectively, of the barrette are folded, a relatively "Z" or "N" shape may be formed depending on the direction of the clip. To completely close the barrette, the first segment 20 is folded over the second segment 40 until catch 32 meets opening 52. Catch 32 may then be inserted into opening 52 to secure the first segment 20 to second segment 40. Further, the third segment, may then or simultaneously be folded under the second segment 40 until catch 72 meets opening 42. Catch 72 may then be inserted into opening 42 to secure the third segment 60 to second segment 40. FIG. 8 shows an embodiment of the barrette of the present invention in the completely closed position.

As discussed above, the first side 12 of the first segment 20 and the second side 14 of the third segment 60 have strategically placed teeth 30 and 70, respectively. Likewise, the first side 12 of the first segment 20 and the second side 14 of the third segment 60 have strategically placed depressions 34 and 74, respectively. The teeth are to prevent hair slippage and secure the hair within the barrette 10. While the placement and number of teeth or rows of teeth may vary, it is preferred that enough teeth and rows of teeth are incorporated to minimize hair slippage while still allowing for easy handling of the barrette. The depressions create space for hair within the barrette when the first and third segments are folded over the second segment. In the embodiments shown in FIGS. 2 and 3, most of the teeth 30 and 70 are located within the depressions 34 and 74, respectively, while a few teeth 30 and 70 are located outside of the depressions 34 and 74, respectively. In an alternative embodiment, all of the teeth are located within the depressions. In a further alternative embodiment, approximately half of the teeth are located within the depression while the other half of the teeth are located on the surface outside of the depression. Additionally, the teeth are preferably dimension and positioned so that they do not interfere with the functionality of the barrette. For example, the teeth do not extend further than the opposing surface of the second segment when the barrette is in the closed position. This allows for the tightly closed configuration, such as shown in FIG. 8.

To secure hair within barrette 10, the Barrette is preferably bent at least to the position shown in FIG. 7. At this position hair may be placed between the first and second segments 20 and 40, respectively, and/or the third and second segments 60 and 40, respectively. When the hair is positioned preferably among the teeth 30 and 70, the first and third segments 20 and 60, respectively are pressed inward toward second segment 40 and the catches 32 and 72 are secured into the coordinating openings 52 and 42, respectively on second segment 40. Once the barrette 10 is in the closed position, the teeth 30 and 70 in combination with the catches 32 and 72 secured in openings 52 and 42, respectively, trap the hair in place. Further, regardless of the position of the hair, the ornamental design of the barrette will be shown. To release the hair from the barrette 10, the non-hinge ends 85 and 95 of the first and third segments, respectively, of the barrette 10 are pried upward allowing the clip to open and the hair to release from the teeth 30 and 70 of the barrette 10.

To further secure the strands in place, hair may be wrapped around the second segment 40 before the three segments of the barrette 10 are fastened together. Further, additional depressions may be incorporated on the first, second and/or third segments 20, 40, and 60, respectively, to provide extra space for hair within or wrapped around the second segment 40 of the barrette.

The embodiment shown in FIG. 1 includes two hinges and catches 32 and 72 positioned on the non-hinge ends 85 and 95 of the first and third segments. In an alternative embodiment wherein all segments are hinged from a single hinge on a single common end of the barrette, the openings and catches may be positioned on a common opposing non-hinged side of the barrette. In yet another alternative embodiment, the segments are connected using a three-part hinge.

In the embodiment of FIGS. 2 and 3, both the first and second segments, 20 and 60, respectively, have the same generally oval lady bug design and shape including a body 16, 16' and a head 18, 18', respectively. Furthermore, while the ornamental designs 22 and 62 of the first and third segments 20 and 60, respectively, are on opposing first and second sides 12 and 14, respectively, of the barrette 10, the shapes of the lady bugs are oriented in the same direction. For example, both lady bug bodies 16, 16' are positioned before and to the left of, the lady bug heads 18, 18'. While the ornamental designs of the first and third segments 20 and 60, respectively, are identical in the embodiment of FIGS. 2 and 3, alternative embodiments may incorporate varying shapes and/or designs on the first and third segments. For example, in alternative embodiments, the barrette may be two distinct shaped first and third segments. Furthermore, the shapes and/or designs of the first and third segments may be oriented in opposite directions. For example, the shape of first segment 20 may be rotated 180 degrees so that the lady bug body 16 is positioned after, and to the right of, the lady bug head 18.

Figure 9:
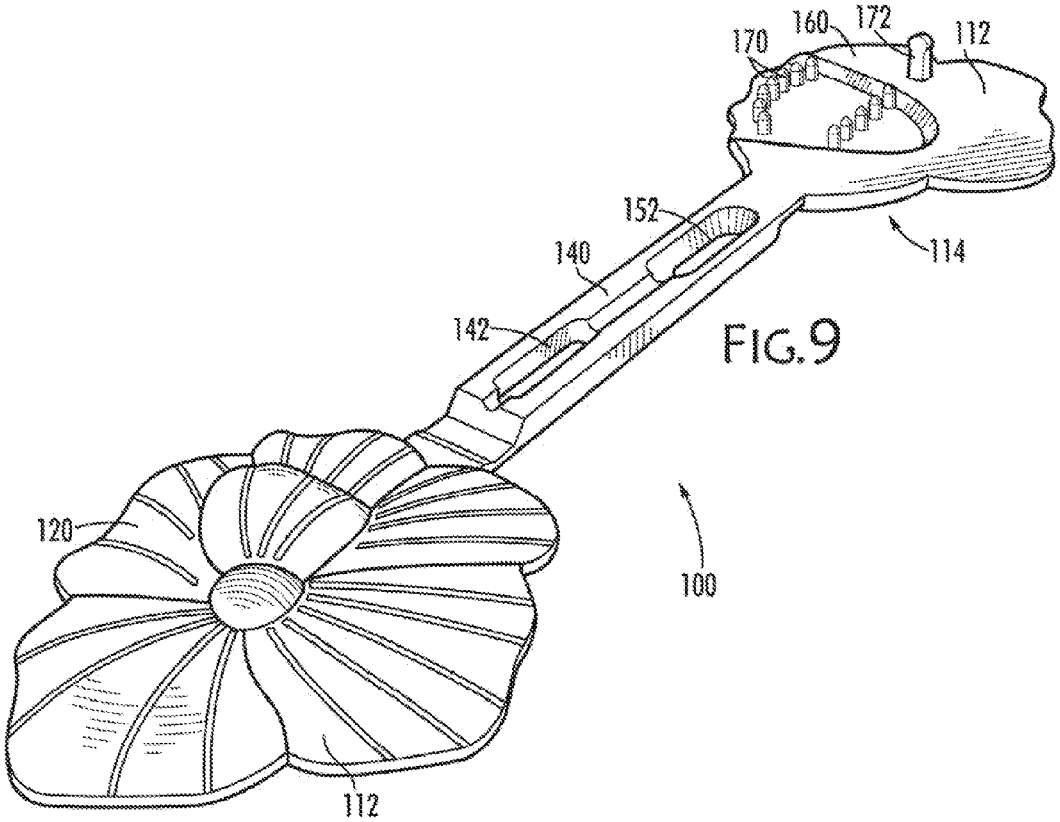
FIG. 9 is a perspective view of another embodiment of the double faced hair barrette of the present invention.
Figure 10:
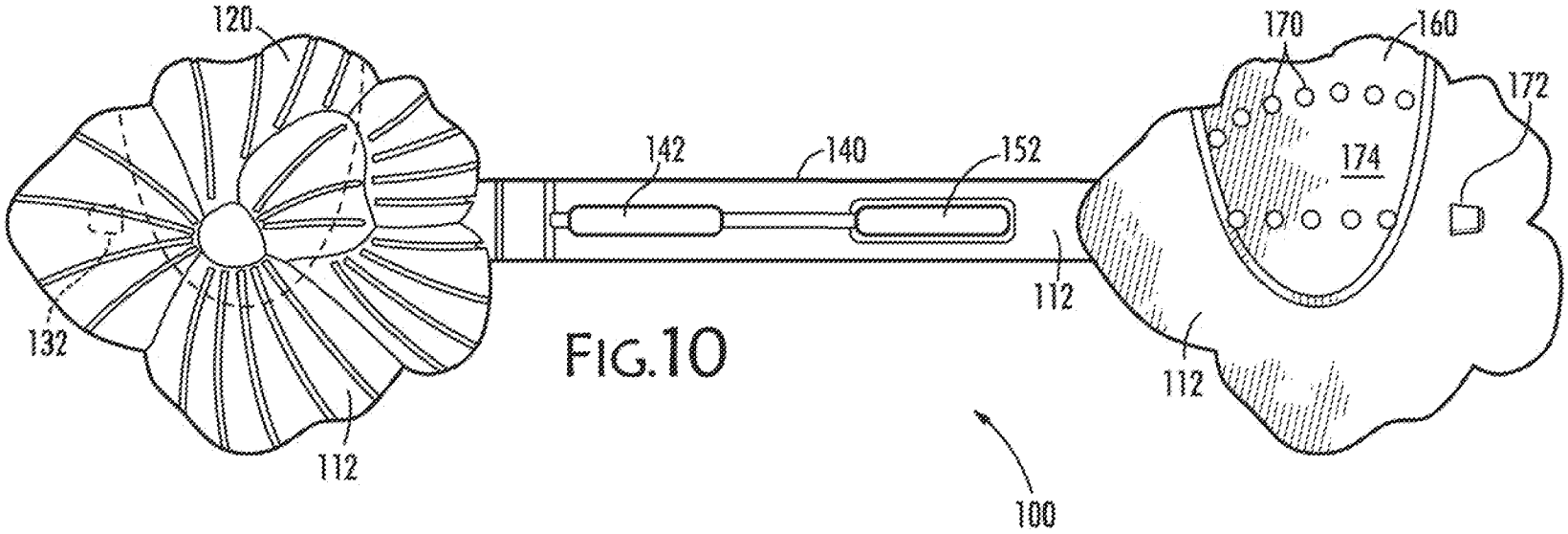
FIG. 10 is a top plan view of the embodiment of FIG. 9.

Barrette 100 shown in FIGS. 9 and 10 disclose an alternative embodiment of the present invention. As shown in these figures, a similar configuration to the embodiment of FIG. 1 is disclosed except that a flower design, such as a sweet pea, is incorporated instead of a lady bug. Like the lady bug barrette 10, the sweet pea barrette 100 includes a first segment 120, a second segment 140 having openings 142 and 152, and a third segment 160. The barrette 100 includes two sides 112 and 114 and the first and third segments include catches 132 and 172, respectively, for insertion into openings 152 and 142, respectively. As shown in FIG. 9, third segment 160 includes teeth 170.

Alternative designs configurations incorporating any number of ornamental designs, such as ovals, watermelons, butterflies, and bees, are contemplated without departing from the spirit and scope of the present invention. Furthermore, the ornamental design may include a simple depression for attaching a design, such as a sticker, into the depression. In another configuration, the ornamental design may be removably attached to the barrette. Regardless of the ornamental design, the present invention creates a distinct barrette by allowing the ornamental design of the barrette to be seen from various angles, even when the barrette is turned or moved.

While various embodiments of the present invention have been described above, it should be understood that they have been presented by way of example, and not limitation. It will be apparent to persons skilled in the relevant art(s) that various changes in form and detail can be made therein without departing from the spirit and scope of the present invention, hi fact, after reading the above description, it will be apparent to one skilled in the relevant art(s) how to implement the invention in alternative embodiments. For example, several configurations with modified shapes, sizes, and dimension of the features of the hair barrette are suitable for the design of the hair barrette of the present invention. Likewise, other configurations altering the number of parts, attachment positions of the parts, means for attaching and securing the parts could be employed to demonstrate the invention and are intended to be encompassed by the present invention. Thus, the present invention should not be limited by the description or any of the above described exemplary embodiments.

In addition, it should be understood that the figures, which highlight the functionality and advantages of the present invention, are presented for purposes of example only. The architecture of the present invention is sufficiently flexible and configurable, such that it may be used in ways other than that shown in the accompanying figures.

What is claimed is:

1. A hair barrette comprising:

a first segment having a first side and an opposing second side, said first side having first teeth and a first catch and said opposing second side including a first ornamental design;

a second segment having a third side and an opposing fourth side, said third side having second teeth and a second catch and said fourth side including a second ornamental design; and a third segment positioned between said first and second segments, said third segment having a body comprising a first end, a second end, an upper surface, and a lower surface, the body of said third segment further having a first opening adjacent to said first end and a second opening adjacent to said second end, the first and second openings are each disposed through the body between said upper surface and said lower surface with an upper slot connecting the first and second openings, wherein the upper slot is disposed on the upper surface of the body and does not extend through to the lower surface of the body, said third segment further having a first hinge extending laterally outward from said first end and a second hinge extending laterally outward from said second end, said first hinge is secured to said first segment and said second hinge is secured to said second segment;

wherein said first catch of said first segment is insertable into said second opening of said third segment and said second catch of said second segment is insertable into said first opening of said third segment;

wherein said first ornamental design is visible when said first catch is inserted into said second opening and said second ornamental design is visible when said second catch is inserted into said first opening.

2. The hair barrette of claim 1 wherein said first segment is foldable over said upper surface of said third segment and said second segment is foldable over said lower surface of said third segment.

3. The hair barrette of claim 1 wherein said first opening and said second opening are disposed entirely through said third segment from said lower surface to said upper surface.

4. The hair barrette of claim 1 wherein said first hinge is positioned adjacent to said upper surface.

5. The hair barrette of claim 4 wherein said second hinge is positioned adjacent to said lower surface.

6. The hair barrette of claim 1 wherein said first side of said first segment further comprises a first depression, said first teeth positioned within said first depression.

7. The hair barrette of claim 6 wherein said third side of said second segment further comprises a second depression, said second teeth positioned within said second depression.

8. The hair barrette of claim 1 wherein said first ornamental design and said second ornamental design are the same.

9. The hair barrette of claim 1 wherein said first opening and said second opening are rectangular in shape.

10. The hair barrette of claim 1 wherein said first teeth are for engaging hair and said hair is secured between said first segment and said third segment.

11. The hair barrette of claim 10 wherein said second teeth are for engaging hair and said hair is secured between said second segment and said third segment.

12. The hair barrette of claim 1 further comprising a lower slot connecting the first and second openings, wherein the lower slot is disposed on the lower surface of the body and does not extend through to the upper surface of the body.

13. A hair barrette comprising:

a first segment having a first side and an opposing second side, said first side having first teeth and a first catch and said opposing second side including a first ornamental design;

a second segment having a third side and an opposing fourth side, said third side having second teeth and a second catch and said fourth side including a second ornamental design; and a third segment having a body with an upper surface, a lower surface, a slot, a first opening, and a second opening, the first and second openings disposed through the body between the upper surface and the lower surface, wherein the slot connects the first and second openings and extends only partially between the upper surface and the lower surface, the third segment further having a first and a second hinge extending laterally outward from opposing ends of said body, said third segment positioned between and secured to said first and second segments;

wherein said first catch of said first segment is for insertion in said first opening of said third segment.

14. The hair barrette of claim 13 wherein said second catch of said second segment is for insertion in said second opening of said third segment.

15. The hair barrette of claim 13 wherein said first segment further has a first depression, said first teeth positioned within said first depression.

16. The hair barrette of claim 15 wherein said second segment further has a second depression, said second teeth positioned within said second depression.

17. The hair barrette of claim 13 wherein said first and second openings are rectangularly shaped.

18. The hair barrette of claim 13 wherein said first and second openings are tapered.

19. The hair barrette of claim 13 wherein said first teeth of said first segment include at least two rows of teeth.

20. The hair barrette of claim 19 wherein a first row of said at least two rows of teeth are positioned along an edge of said first segment and a second row of said at least two rows of teeth are positioned along a centerline of said first segment.

* * * * *